US005336860A

United States Patent [19]

Slocum

[11] Patent Number: 5,336,860

[45] Date of Patent: Aug. 9, 1994

[54] PUSHBUTTON ACTUATOR

[75] Inventor: Richard T. Slocum, Aliso Viejo, Calif.

[73] Assignee: WangDat, Inc., Irvine, Calif.

[21] Appl. No.: 869,600

[22] Filed: Apr. 16, 1992

[51] Int. Cl.[5] ..... H01H 9/02

[52] U.S. Cl. ..... 200/332.1; 200/345

[58] Field of Search ..... 200/332.1, 345, 341

[56] References Cited

U.S. PATENT DOCUMENTS 4,463,237 7/1984 Kim ..... 200/345

4,803,316 2/1989 Hayashi et al. ..... 200/345

FOREIGN PATENT DOCUMENTS 1222139 8/1966 Fed. Rep. of Germany ... 200/332.1

3112328 10/1982 Fed. Rep. of Germany ..... 200/341

227317 9/1989 Japan ..... 200/341

1219022 1/1971 United Kingdom ..... 200/345

*Primary Examiner*—Renee S. Luebke

*Attorney, Agent, or Firm*—Robbins, Berliner & Carson

[57] ABSTRACT

An improved actuator switch for transmitting a function to a PC board that is not directly attached to the actuator switch. The actuator switch provides a large amount of alignment tolerance without loss of function. Further, the actuator switch is easy to assemble, requiring no assembly tools because the entire mechanism snaps together.

17 Claims, 2 Drawing Sheets

PUSHBUTTON ACTUATOR

BACKGROUND OF THE INVENTION

1. Field of the Invention

This invention relates in general to actuators, and in particular to an improved pushbutton or actuator.

2. Description of Related Art

Many floppy disk drives or tape drives contain a pushbutton switch on a face plate or bezel of the drive. Typically, the switch invokes an ejection function of the drive. The switch must be connected to a PC board controlling the drive in order to provide the desired function. Typically, this connection is either mechanical or electrical.

In the prior art, such connections require very precise tolerances and alignment or electrical cabling to ensure that there is no loss of function. Any misalignment beyond a very small tolerance can prevent the correct operation of the switch. Such precise alignment, however, causes problems.

For example, assembly may be costly because of the need for precise alignment. Further, there is a strong inverse correlation between the amount of alignment tolerance and the number of manufacturing defects that occur. In addition, transportation is also a problem, because jarring and rough handling can cause misalignment. Misalignment can also occur during normal usage.

SUMMARY OF THE INVENTION

To overcome the limitations in the prior art described above, and to overcome other limitations that will become apparent upon reading and understanding this specification, the present invention discloses an improved pushbutton actuator for transmitting a function to a PC board that is not directly attached to the pushbutton. The present invention provides a large amount of alignment tolerance without loss of function. Further, the present invention is easy to assemble, requiring no tools because the entire mechanism snaps together.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
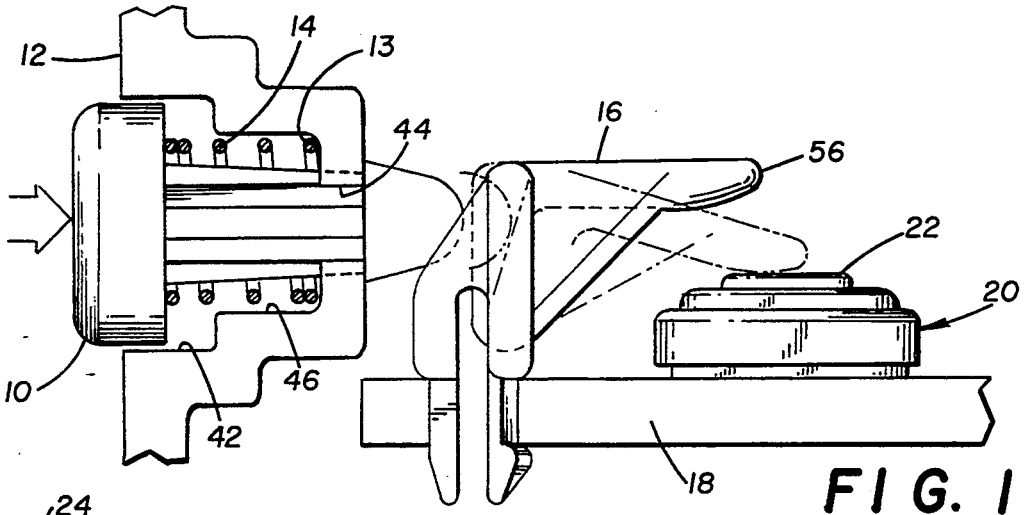
FIG. 1 is a cross-sectional elevational view of the improved actuator.

Referring now to FIG. 1, actuator 10 is mounted in a bezel 12. The actuator 10 is pressed to activate and/or de-activate an associated function. A coil spring 14 is mounted within the bezel 12 and held in place against bezel shoulders 13 by the actuator 10. The assembly of the actuator 10 and coil spring 14 in the bezel 12 requires no tools; it simply snaps together. When the actuator 10 is pressed, it applies force against a link 16 mounted on a PC board 18. The link 16 is "hinged" so a rollover surface 56 is pushed downward by the applied force and presses against a contact surface 22 of an electrical switch 20 mounted on a PC board 18. The downward force of the link 16 against the contact surface 22 alternately activates and de-activates the electrical switch 20.

Figure 2:
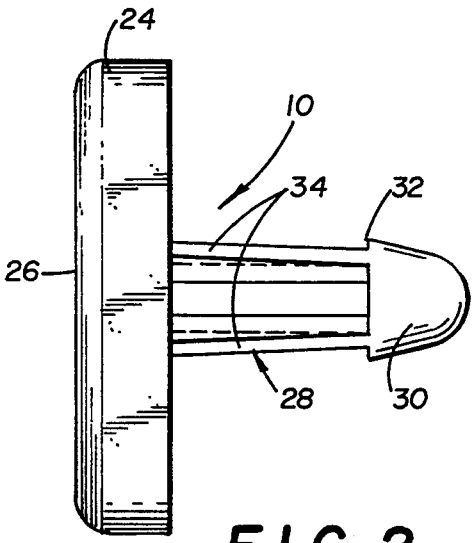
FIG. 2 is an enlarged side elevational view of the improved actuator.

FIG. 2 is an enlarged view of the actuator 10 shown in FIG. 1. The actuator 10, comprised of injection molded thermoplastic, has a head 24 which, in this embodiment, measures 0.5 inches in length by 0.1 inches in depth. The head 24 provides a finger contact surface 26, which is pressed to activate and/or deactivate the desired function. The actuator 10 has an integral shaft 28, which extends through the bezel 12 to press against the link 16. The shaft 28 of the actuator 10 measures 0.425 inches in length from the finger contact surface 26 to the tip. The dimensions of the shaft 28 can be altered so that the link 16 is placed closer or farther from the actuator on the PC board 18. The shaft 28 includes a snap detail 30 and lip 32 that locks the shaft into the bezel 12. The snap detail 30 presses against the link 16, and ribs 34 along the length of the shaft 28 align the actuator 10 in the bezel 12 and prevent the actuator 10 from rotating therein. The ribs 34 are approximately 0.024 inches wide and 0.026 inches high. The base of the shaft 28 measures approximately 0.145 inches in diameter at the point where the shaft 28 joins the head 24, and tapers to a diameter of 0.125 inches at the lip 32 of the snap detail 30.

Figure 3:
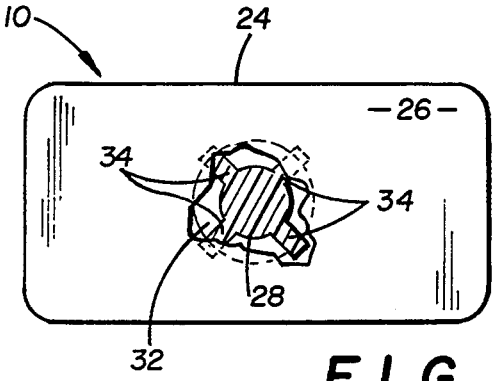
FIG. 3 is an enlarged elevational, partly cross-sectional view of the head of the improved actuator.

FIG. 3 provides an enlarged view of the head 24 of the actuator 10. The head 24 measures 0.5 inches by 0.250 inches. A portion of the head 24 is broken away in FIG. 3 to show a cross-section of the shaft 28 extending away from the head 24 and which is centered on the head 24. The shaft 28, not including the ribs 34, measures 0.071 inches in diameter. The ribs 34 are approximately 0.024 inches wide and 0.026 inches high.

Figure 4:
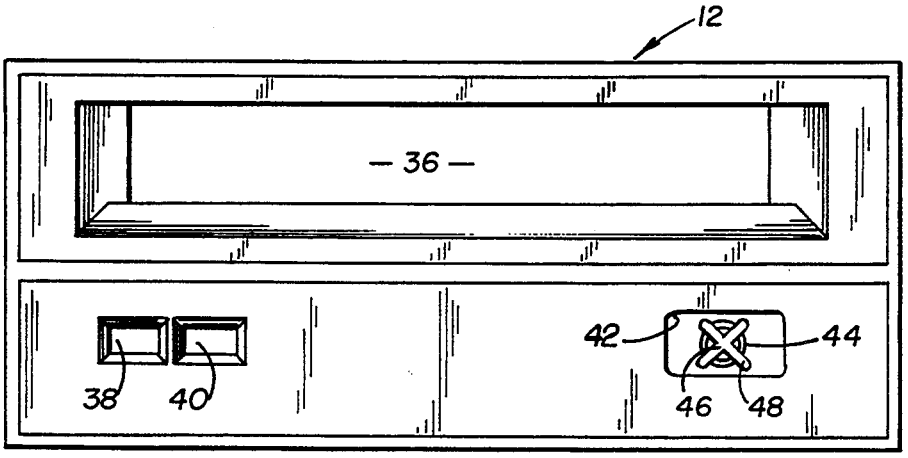
FIG. 4 is a front elevational view of a bezel containing a receptacle for the actuator.

FIG. 4 is a front view of the bezel 12. The bezel 12 provides a face plate for a tape drive or other device, and fits a standard 3.5 inch enclosure. The bezel 12 includes a cassette entrance 36, lens apertures 38 and 40 for LEDs, and a receptacle 42 for receiving the actuator 10. The receptacle 42 measures 0.540 inches by 0.290 inches. The receptacle 42 includes a bore 44 through the bezel 12 for receiving the shaft 28, a cavity 46 for receiving and aligning the coil spring 14 within the bezel 12, and clearances 48 cut out of the cavity 46, which clearances 48 receive the ribs 34 on the shaft 28 to align the actuator 10.

At assembly, the actuator 10 is pressed into the receptacle 42 so that the shaft 28 is received by the bore 44. The bore 44 for the shaft 28 measures 0.075 inches in diameter. The snap detail 30 is slightly larger than the bore 44 so the bore 44 deforms slightly as the snap detail 30 passes through during assembly. The bore 44 returns to its original position as the snap detail 30 exits from the bore 44. The lip 32 on the snap detail 30 prevents the snap detail 30 from being pulled back through the bore 44.

The cavity 46 for the coil spring 14 has a diameter of 0.188 inches. The cavity 46 is broken up by clearances 48 for the ribs 34. These clearances 46 allow the shaft 28 and ribs 34 to be pushed through the bezel 12, and eases the temporary deformation of the thermoplastic of the bezel 12 to prevent the thermoplastic from breaking as the snap detail 30 passes through.

Figure 5:
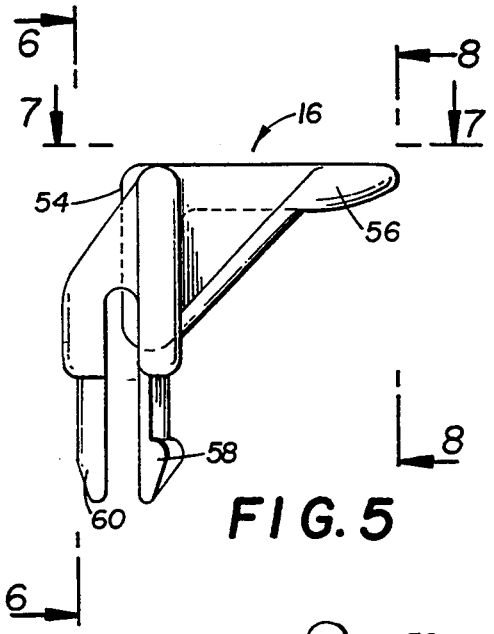
FIG. 5 is an enlarged elevational view of a link connecting the actuator with a switch on a PC board.

FIG. 5 provides an enlarged view of the link 16. The link 16 is typically mounted on a PC board 18. No assembly tools are required to mount the link 16 in the PC board 18; the link 16 is mounted simply by pressing the link 16 downward so that locators 58 and pegs 60 pass through apertures (not shown) in the PC board 18. The locators 58 are configured to "lock" the link 16 into the PC board 18 and prevent it from being pulled therefrom. Further, the locked locators 58 act as a hinge for the movement of the link 16. The pegs 60 act as springs.

In a quiescent state, there is clearance between the snap detail 30 and the contact surface 54 of the link 16. However, when the actuator 10 is pressed, the shaft 28 extends through the bore 46 and the snap detail 30 is pressed against the contact surface 54. In response to the force applied by the snap detail 30 against the contact surface 54, a rollover surface 56 displaces downward onto the snap action contact surface 22 to actuate the electrical switch 20. Locators 58 translate the horizontal force applied by the snap detail 30 into vertical force applied by the rollover surface 56. Locators 58 also prevent any movement out that might pull the link 16 from its mounting in the PC board 18. Pegs 60 cause the link 16 to return to its original position when the force applied by the snap detail 30 is removed from the contact surface 54. Alternative configurations may interface the actuator 10 to different links 16 and/or different switches 20.

The link 16 measures 0.351 inches from the top to the tips of the locators 60. The locators 60 and pegs 58 both measure 0.132 inches of which 0.070 inches are encased in the PC board 18 and of which 0.062 inches extend from the bottom of the PC board 18. The rollover surface 56 extends 0.247 inches behind the shoulders of the locators 58 and measures 0.350 inches in width and 0.050 inches in depth.

The link 16 is preferably comprised of an engineering plastic that provides more "spring" than the thermoplastic used in the actuator 10. Additional spring is required because, in the preferred embodiment, the engineering plastic goes through more cycles in use, and because it is deformed during each use. The actuator 10, on the other hand, is used in a manner that typically exerts little stress on the actuator 10.

Figure 6:
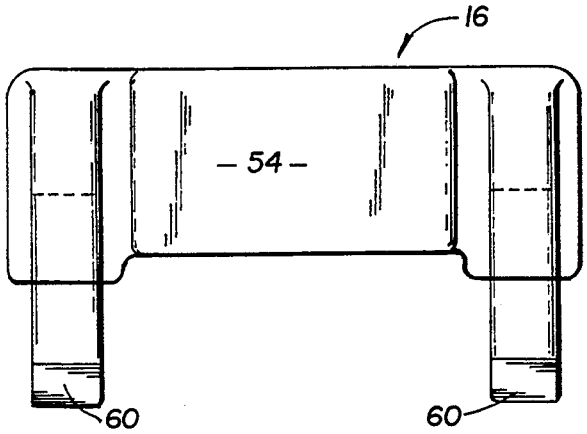
FIG. 6 is an elevational view taken along the line 6—6 of FIG. 5 looking straight at a contact surface of the link.

FIG. 6 is a view from the left of FIG. 6 looking straight on into the contact surface 54 of the link 16. The entire link 16 is 0.625 inches in width with the contact surface 54 measuring 0.350 inches by 0.139 inches. The dimensions of the link contact surface 54 and the length of the shaft 28 on the actuator determine the amount of alignment tolerance between the actuator 10, i.e., the shaft 28, and the link 16. The larger the size of the contact surface 54, the greater the amount of tolerance for misalignment. The dimensions of the contact surface 54 and the link 16 can be altered in various dimensions to make the arrangement work for any type of actuator 10 and bezel 12, any placement of the actuator 10 on the bezel 12, and any amount of gross misalignment between the actuator 10 and the link 16.

Figure 7:
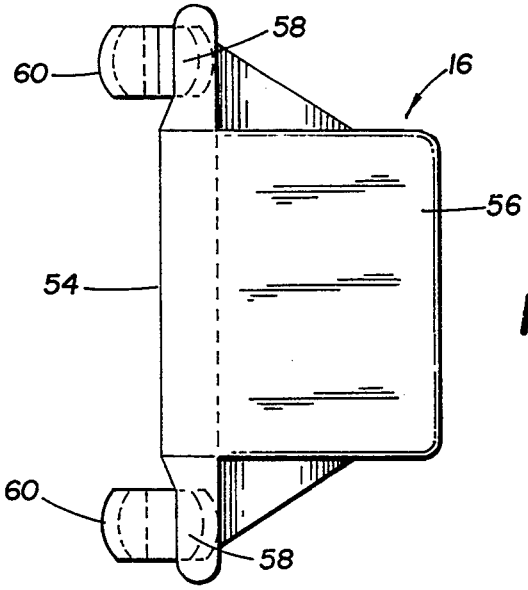
FIG. 7 is a plan view taken along the line 7—7 of FIG. 5 looking down onto the link and the top of a rollover surface.

FIG. 7 is a view from the top of FIG. 6 looking down onto the link 16 and the top of the rollover surface 56. The rollover surface 56 measures 0.350 inches in width by 0.247 inches in length (measuring from the shoulders of the locators 58 back to the edge of the rollover surface 56). The dimensions of the rollover surface 56 determine the amount of alignment tolerance between the link 16 and the snap-action contact surface 22 of the switch 20 mounted on the PC board 18. The larger the size of the rollover surface 56, the greater the amount of tolerance for misalignment. The dimensions of the rollover surface 56 can be altered in various dimensions to make the arrangement work for any type of switch 20, any placement of the switch 20 on the PC board 18, and any amount of gross misalignment between the rollover surface 56 and the switch 20.

Figure 8:
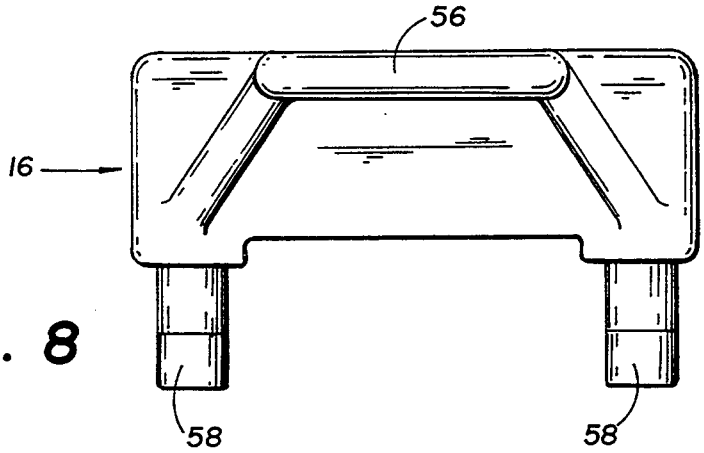
FIG. 8 is an elevational view taken along the line 8—8 of FIG. 5 looking edgewise into the rollover surface of the link.

FIG. 8 is a view from the right side of FIG. 6 looking edgewise into the rollover surface 56 of the link 16. The rollover surface 56 measures approximately 0.05 inches thick.

In summary, an improved actuator switch has been described, which actuator switch transmits a function to a PC board that is not directly attached to the actuator switch. The actuator switch provides a large amount of alignment tolerance without loss of function. Further, the actuator switch is easy to assemble, requiring no assembly tools because the entire mechanism snaps together.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for transmitting a function to a switch, comprising:

an actuator mounted in a first supporting member and having a shaft which extends through a bore in the first supporting member, wherein force is alternately applied and removed from the actuator to activate and de-activate the function, wherein the first supporting member comprises a cavity centered about the center of the bore;

a link member, remotely disposed between both the actuator and the switch, mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator;

a second contact surface adapted to press against a contact surface of the switch when force is applied to the first contact surface, the second contact surface having a sufficiently large projection onto a plane parallel to the contact surface of the switch to allow for misalignment of the link member and the switch in the plane parallel to the contact surface of the switch; and means for hinging the link so that when the shaft presses against the first contact surface of the link, the link pivots about its point of mounting with the second supporting member in a plane that is substantially normal to the second supporting member so that the second contact surface of the link is pushed downward to activate the function; and a coil spring mounted in the cavity of the first supporting member and held in place there by the actuator, wherein the coil acts to remove the shaft of the actuator from the first contact surface of the link when force is removed from the actuator.

2. An apparatus for transmitting a function to a switch, comprising:

an actuator mounted in a first supporting member and having a shaft which extends through a bore in the first supporting member, wherein force is alternately applied and removed from the actuator to activate and de-activate the function;

a link member, remotely disposed between both the actuator and the switch, mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator;

a second contact surface adapted to press against a contact surface of the switch when force is applied to the first contact surface, the second contact surface having a sufficiently large projection onto a plane parallel to the contact surface of the switch to allow for misalignment of the link member and the switch in the plane parallel to the contact surface of the switch;

means for hinging the link so that when the shaft presses against the first contact surface of the link, the link pivots about its point of mounting with the second supporting member in a plane that is substantially normal to the second supporting member so that the second contact surface of the link is pushed downward to activate the function; and a clearance gap between the shaft of the actuator and the first contact surface of the link when force is removed from the actuator.

3. An apparatus for transmitting a function to a switch, comprising:

an actuator mounted in a first supporting member and having a shaft, which extends through a bore in the first supporting member, wherein force is alternately applied and removed from the actuator to activate and de-activate the function; and a link member, remotely disposed between both the actuator and the switch, mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator;

a second contact surface adapted to press against a contact surface of the switch when force is applied to the first contact surface, the second contact surface having a sufficiently large projection onto a plane parallel to the contact surface of the switch to allow for misalignment of the link member and the switch in the plane parallel to the contact surface of the switch;

means for hinging the link so that when the shaft presses against the first contact surface of the link, the link pivots about its point of mounting with the second supporting member in a plane that is substantially normal to the second supporting member so that the second contact surface of the link is pushed downward to activate the function; and wherein the shaft is comprised of a plurality of ribs for aligning the actuator in the first supporting member and for preventing the actuator from rotating therein;

wherein the first supporting member comprises a plurality of clearances cut into the bore to accept the ribs on the shaft.

4. An apparatus for transmitting a function to a switch, comprising:

an actuator mounted in a first supporting member and having a shaft, which extends through a bore in the first supporting member, wherein force is alternately applied and removed from the actuator to activate and de-activate the function; and a link member, remotely disposed between both the actuator and the switch, mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator;

a second contact surface adapted to press against a contact surface of the switch when force is applied to the first contact surface, the second contact surface having a sufficiently large projection onto a plane parallel to the contact surface of the switch to allow for misalignment of the link member and the switch in the plane parallel to the contact surface of the switch;

means for hinging the link so that when the shaft presses against the first contact surface of the link, the link pivots about its point of mounting with the second supporting member in a plane that is substantially normal to the second supporting member so that the second contact surface of the link is pushed downward to activate the function; and wherein the shaft is comprised of a snap detail on a tip thereof for pressing against the first contact surface of the link, wherein the snap detail is substantially rounded.

5. The apparatus of claim 4, wherein the snap detail is further comprised of a lip thereon to prevent the snap detail from being pulled back through the bore.

6. The apparatus of claim 4, wherein the snap detail is slightly larger than the bore, so that the bore deforms outwardly as the snap detail passes therethrough during assembly.

7. The apparatus of claim 6, wherein the bore further comprises a plurality of clearances for allowing the shaft to be pushed therethrough by promoting deformation of the bore, thereby preventing the first supporting member from breaking as the snap detail passes therethrough.

8. An apparatus for transmitting a function to a switch, comprising:

an actuator mounted in a first supporting member and having a shaft, which extends through a bore in the first supporting member, wherein force is alternately applied and removed from the actuator to activate and de-activate the function;

a link member, remotely disposed between both the actuator and the switch, mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator;

a second contact surface adapted to press against a contact surface of the switch when force is applied to the first contact surface, the second contact surface having a sufficiently large projection onto a plane parallel to the contact surface of the switch to allow for misalignment of the link member and the switch in the plane parallel to the contact surface of the switch; and means for hinging the link so that when the shaft presses against the first contact surface of the link, the link pivots about its point of mounting with the second supporting member in a plane that is substantially normal to the second supporting member so that the second contact surface of the link is pushed downward to activate the function;

a locator configured to lock the link into the second supporting member and to prevent the link from being pulled therefrom; and a peg extending through the second supporting member and secured substantially parallel to the locator configured to act as a spring for the link, so that when force is removed from the link it returns to an original position.

9. An apparatus for transmitting a function to a switch, comprising:

an actuator mounted in a first supporting member and having a shaft, which extends through a bore in the first supporting member, wherein force is alternately applied and removed from the actuator to activate and de-activate the function;

a link member, remotely disposed between both the actuator and the switch, mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator;

a second contact surface adapted to press against a contact surface of the switch when force is applied to the first contact surface, the second contact surface having a sufficiently large projection onto a plane parallel to the contact surface of the switch to allow for misalignment of the link member and the switch in the plane parallel to the contact surface of the switch; and means for hinging the link so that when the shaft presses against the first contact surface of the link, the link pivots about its point of mounting with the second supporting member in a plane that is substantially normal to the second supporting member so that the second contact surface of the link is pushed downward to activate the function; and wherein the second contact surface of the link comprises a substantially rounded rollover surface.

10. An apparatus for transmitting a function to a switch, comprising:

an actuator mounted in a first supporting member and having a shaft, which extends through a bore in the first supporting member, wherein force is alternately applied and removed from the actuator to activate and de-activate the function; and a link member mounted in a second supporting member, wherein the link member comprises:

a locator configured to lock the link into the second supporting member and to prevent the link from being pulled therefrom;

a peg extending through the second supporting member and secured substantially parallel to the locator configured to act as a spring for the link, so that when force is removed from the link it returns to an original position;

a first contact surface having a first area for receiving the shaft of the actuator when the actuator is depressed; and a second contact surface having a second area for pressing against the switch when force is applied to the first contact surface, wherein the first area determines an amount of tolerance for misalignment between the actuator and the link, and wherein the second area determines an amount of tolerance for misalignment between the link and the switch.

11. An improved switch apparatus, comprising:

a switch having a contact surface thereon for activating and deactivating as pressure is alternately applied and removed from the contact surface;

an actuator mounted in a first supporting member, the actuator having a shaft which extends through a bore in the first supporting member, wherein force is alternately applied and removed from the actuator to activate and de-activate the switch; and a link member mounted in a second supporting member, wherein the link member comprises:

a locator configured to lock the link into the second supporting member and to prevent the link from being pulled therefrom;

a peg extending through the second supporting member and secured substantially parallel to the locator configured to act as a spring for the link, so that when force is removed from the link it returns to an original position;

a first contact surface for receiving the shaft of the actuator when the actuator is depressed; and a second contact surface for pressing against the contact surface of the switch when force is applied to the first contact surface by the shaft of the actuator, wherein the link translates force applied against the first contact surface in a first direction into force applied by the second contact surface in a second direction.

12. An improved switch apparatus, comprising:

an electrical switch having a contact surface thereon for activating and deactivating the electrical switch as pressure is alternately applied and removed from the contact surface;

an actuator mounted in a first supporting member, the actuator having a shaft which extends through a bore in the first supporting member, wherein force is alternately applied and removed from the actuator to activate and de-activate the switch; and a link member mounted in a second supporting member, wherein the link member comprises:

a locator configured to lock the link into the second supporting member and to prevent the link from being pulled therefrom;

a peg extending through the second supporting member and secured substantially parallel to the locator configured to act as a spring for the link, so that when force is removed from the link it returns to an original position;

a first contact surface for receiving the shaft of the actuator when the actuator is depressed; and a second contact surface for pressing against the contact surface of the switch when force is applied to the first contact surface by the shaft of the actuator, wherein the link is hinged so that the second contact surface is pushed downward to press against the contact surface of the electrical switch when the shaft presses against the first contact surface.

13. An apparatus for transmitting a function to a switch, comprising:

an actuator mounted in a first supporting member and having a shaft, the shaft having a substantially rounded snap detail on a tip thereof, the shaft extending through a bore in the first supporting member, wherein force is alternately applied and removed from the actuator to activate and de-activate the function; and a link member mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator; and a second contact surface adapted to press against a contact surface of the switch when force is applied to the first contact surface, the second contact surface having a sufficiently large projection onto a plane parallel to the contact surface of the switch to allow for misalignment of the link member and the switch in the plane parallel to the contact surface of the switch, wherein the snap detail presses against the contact surface of the link when force is applied to the actuator.

14. The apparatus of claim 13, wherein the snap detail is further comprised of a lip thereon to prevent the snap detail from being pulled back through the bore.

15. The apparatus of claim 13, wherein the snap detail is slightly larger than the bore, so that the bore deforms outwardly as the snap detail passes therethrough.

16. The apparatus of claim 15, wherein the bore further comprises a plurality of clearances for allowing the shaft to be pushed therethrough by promoting deformation of the bore, thereby preventing the first supporting member from breaking as the snap detail passes therethrough.

17. An apparatus for transmitting a function to a switch, comprising:

an actuator mounted in a first supporting member and having a shaft which extends through a bore in the first supporting member, wherein force is alternately applied and removed from the actuator to activate and de-activate the function; and a link member mounted in a second supporting member, the link member comprising:

a first contact surface adapted to be contacted by the shaft of the actuator and having a sufficiently large projection onto a plane normal to the shaft of the actuator to allow for misalignment of the shaft actuator and the link in the plane normal to the shaft of the actuator; and a second contact surface adapted to press against a contact surface of the switch when force is applied to the first contact surface, the second contact surface having a substantially rounded rollover surface; and a sufficiently large projection onto a plane parallel to the contact surface of the switch to allow for misalignment of the link member and the switch in the plane parallel to the contact surface of the switch.

* * * * *

UNITED STATES PATENT AND TRADEMARK OFFICE

CERTIFICATE OF CORRECTION

PATENT NO. : 5,336,860

DATED : August 9, 1994

INVENTOR(S) : Richard T. Slocum

It is certified that error appears in the above-indentified patent and that said Letters Patent is hereby corrected as shown below:

| COLUMN | LINE | |
|---|---|---|
| 2 | 32 | "deactivate" should be --de-activate-- |
| 3 | 33 | "bore 46" should be --bore 44-- |
| 3 | 49 | "locators 60" should be --locators 58-- |
| 3 | 49 | "pegs 58" should be --pegs 60-- |
| 7 | 10 | after "shaft", delete the comma |
| 7 | 50 | after "shaft", delete the comma |
| 8 | 16 | after "shaft", delete the comma |
| 9 | 10 | after "the", insert --electrical-- |
| 9 | 24 | after "the", insert --electrical-- |

Signed and Sealed this

Third Day of January, 1995

*Attest:*

Bruce Lehman

BRUCE LEHMAN

*Attesting Officer*

*Commissioner of Patents and Trademarks*